United States Patent [19]

Hudson, Jr.

[11] Patent Number: 4,519,368

[45] Date of Patent: May 28, 1985

[54] FUEL INJECTION RAIL ASSEMBLY

[75] Inventor: Sharon J. Hudson, Jr., Lambertville, Mich.

[73] Assignee: Sharon Manufacturing Company, Lambertville, Mich.

[21] Appl. No.: 623,403

[22] Filed: Jun. 22, 1984

Related U.S. Application Data

[63] Continuation-in-part of Ser. No. 374,485, May 4, 1982, Pat. No. 4,457,280.

[51] Int. Cl.[3] ..... F02M 55/02

[52] U.S. Cl. ..... 123/468; 123/470; 239/600; 239/533.2

[58] Field of Search ..... 123/468–471; 138/37, 115, 172; 239/600, 533.2, 533.3, 550

[56] References Cited

U.S. PATENT DOCUMENTS

| | | | |
|---|---|---|---|
| 3,776,209 | 12/1973 | Wertheimer et al. | 123/470 |
| 3,929,109 | 12/1975 | Chamberlain | 123/468 |
| 3,930,483 | 1/1976 | Blisko et al. | 123/470 |
| 4,286,563 | 9/1981 | Fahim et al. | 123/469 |
| 4,294,215 | 10/1981 | Hans et al. | 123/470 |
| 4,474,160 | 10/1984 | Gartner | 123/468 |

*Primary Examiner*—Magdalen Y. C. Moy

*Attorney, Agent, or Firm*—Harold F. Mensing

[57] ABSTRACT

A rugged fuel rail assembly for holding a plurality of electromechanical fuel injector elements in aligned positions on an internal combustion engine. The beam portion of the fuel rail is comprised of two elongated manifold members with overlapping sides brazed together. One of the manifold members has a series of planar sites with apertures for retaining and precisely aligning a plurality of injector cups. To prevent vapor locks the injector cups are mounted with their cavities in close proximity to the inside of the fuel rail. In addition to being designed for ease of assembly and to provide adequate rigidity without excessive weight, the fuel rail is designed so that various fabricating steps, including the insertion on an internal divider, can be performed from the inside of the rail members prior to assembly.

8 Claims, 17 Drawing Figures

FUEL INJECTION RAIL ASSEMBLY

CROSS REFERENCE TO RELATED APPLICATIONS

The present application is a continuation-in-part of U.S. patent application Ser. No. 374,485, filed May 4, 1982 and now U.S. Pat. No. 4,457,280.

FUEL INJECTION RAIL ASSEMBLY

1. Field of the Invention

This invention relates to a fuel rail assembly for firmly holding a plurality of fuel injector mechanisms in aligned positions on an internal combustion engine. More particularly it relates to an improved fuel rail assembly which provides greater injector hold-down strength, positive injector cup alignment, internal passageways and greater ease of assembly.

BACKGROUND OF THE INVENTION

One end of each fuel injector is retained in a cup member of the fuel rail and the opposite end is positioned in a cylindrical fuel intake bore of an internal combustion engine. Proper seating and sealing of the opposite ends of the injector in the rail and engine require adequate clamping force and precise axial alignment between the fuel rail cup, the injector axis and the cylindrical fuel intake bore. Therefore it is imperative that means be provided for achieving the required relative alignment during fabrication of the fuel rail assembly. Since the electromechanical fuel injectors currently in use require occasional servicing and replacement, it is also important that the fuel rail assembly be provided with sufficient structural strength to withstand, without permanent bending, the forces involved in removing and reinstalling the fuel rail assembly to service or replace the injectors. Accordingly it is an object of this invention to provide a fuel rail assembly that is relatively lightweight, economical and easy to manufacture, has improved rigidity particularly in the direction of the axes of the injectors and has an injector cup alignment means.

DESCRIPTION OF THE PRIOR ART

A similar fuel rail assembly is illustrated and described in U.S. Pat. No. 3,776,209. This prior art fuel rail assembly is comprised of a plurality of machined injector cup fitments disposed at intervals along a common cylindrical fuel supply tube. The machined fitments have excess material that is not required for strength but merely contributes to excess weight. These fitments have lateral bores through which the supply tube passes and thus the fitments must be threaded on the tube in sequence and cannot be installed simultaneously. No means is provided for rotationally aligning the fitments on the supply tube or fixing them at their relative positions along the tube. Since the tube has uniform wall thickness it may be bent out of shape as easily in one direction as another. In other words it does not have added strength in any preferred direction.

SUMMARY OF THE INVENTION

The improved fuel rail assembly disclosed herein is comprised of a plurality of stamped sheet metal components designed to be readily assembled and then copper brazed in a brazing furnace to produce a structurally rugged unit having improved beam strength. Proper positioning and alignment of the components relative to one another is achieved by built-in positioning and aligning means. The beam portion of the fuel rail assembly is made of two elongated channels or manifold members with overlapping side walls brazed together. One of the manifold members has a plurality of apertured planar sites for holding and aligning an equal number of injector cups. The injector cups have neck sections which protrude through the manifold apertures so that their inner ends may be peened outwardly to lock them in the apertures and cause shoulders on the cups to abut the surrounding planar surfaces thereby precisely aligning the cups. Mounting brackets are brazed on the beam adjacent to its ends. Wherever possible the various parts are designed to enhance the strength of the fuel rail assembly in addition to performing their intended function. For example, the mounting bracket at one end of the fuel rail assembly has a faceplate for mounting a fuel pressure regulator on one side thereof. A fuel sump or chamber is formed by a drawn sheet metal pan of irregular shape brazed on the opposite side. One embodiment has an internal divider which provides flow reversing passageways so that inlet and outlet fitments may be located at one end. These features and others will become apparent to those skilled in the art as the description of three presently preferred embodiments is read in conjunction with the accompanying drawings.

Figure 10:
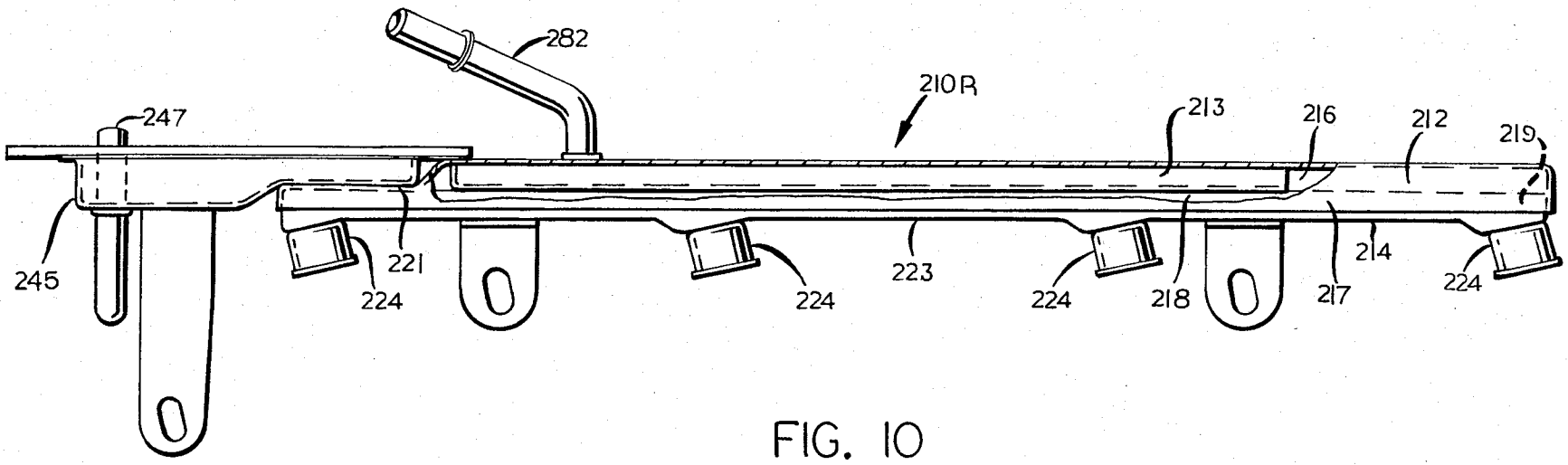
Figure 11:
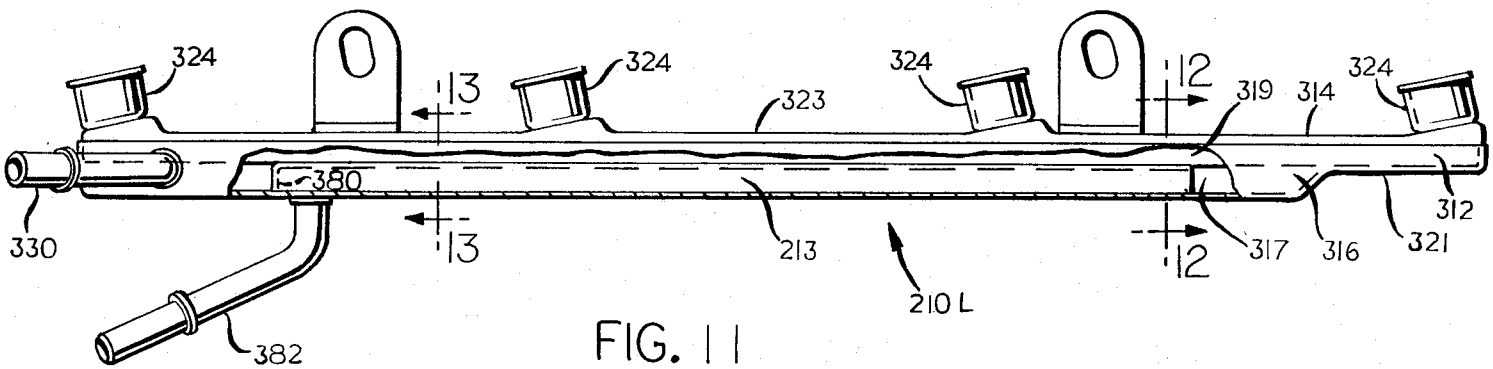
Figure 12:
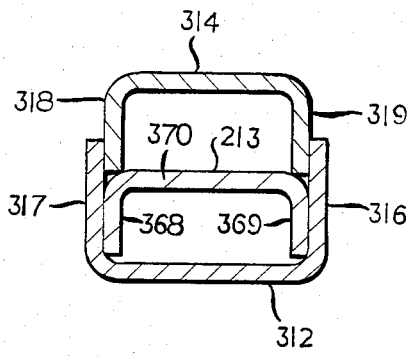
Figure 13:
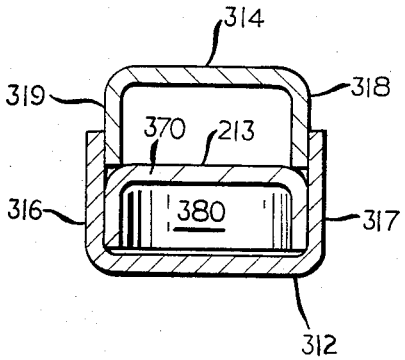
Figure 14:
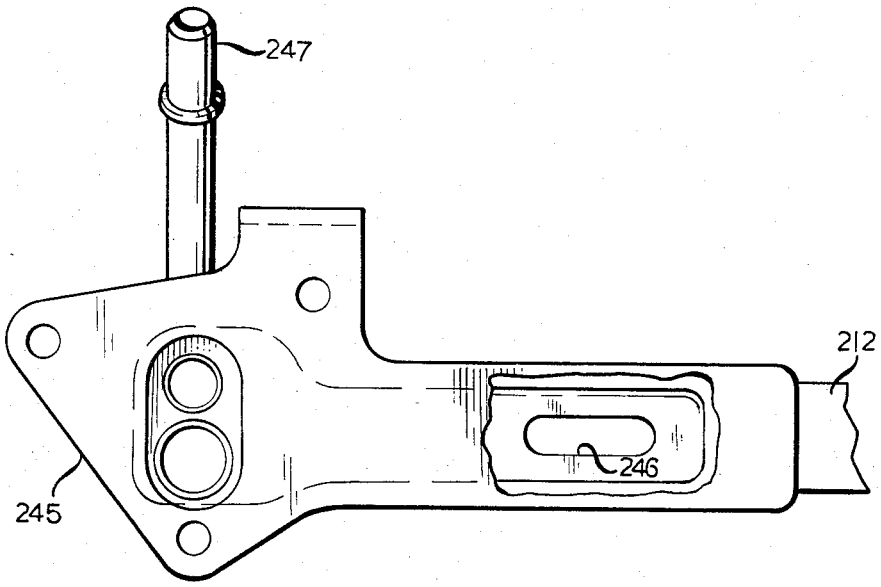

FIGS. *9a, 9b, 9c,* and *9d* are a series of fragmentary cross section views showing the angular relationship between the several injector cup axes;

FIG. 10 is a side view of a fuel rail assembly for the right bank of a V-8 engine having an internal divider member inside the rail;

FIG. 11 is a side view of a fuel rail assembly for the opposite bank of a V-8 engine also having an internal divider member inside the rail;

FIG. 12 is a cross sectional view taken along lines 12—12 of FIG. 11 showing the closed end of the divider member;

FIG. 13 is a cross sectional view taken along lines 13—13 of FIG. 11 showing the open end of the divider member; and FIG. 14 is a fragmentary plan view of the rearward end of the fuel rail assembly of FIG. 10 showing further details of the pressure regulator fitment.

DETAILED DESCRIPTION OF THE DRAWINGS

Figure 5:
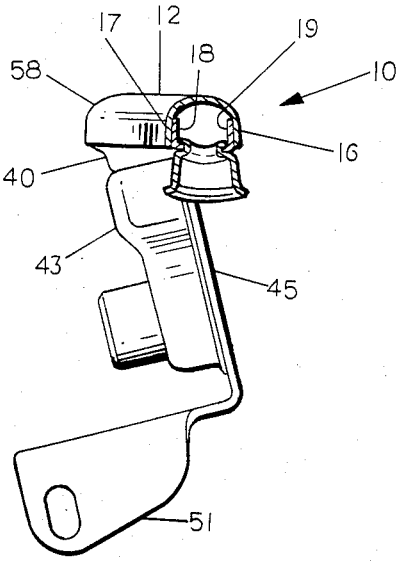
FIG. 5 is a view partially in section taken along line 5—5 of FIG. 1.
Figure 6:
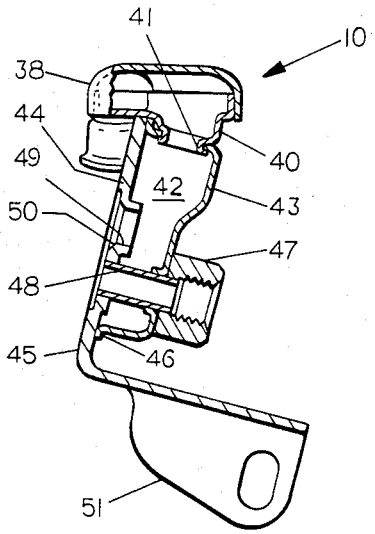
FIG. 6 is a sectional view taken along line 6—6 of FIG. 1 showing internal details of the pressure regulator sump.
Figure 7:
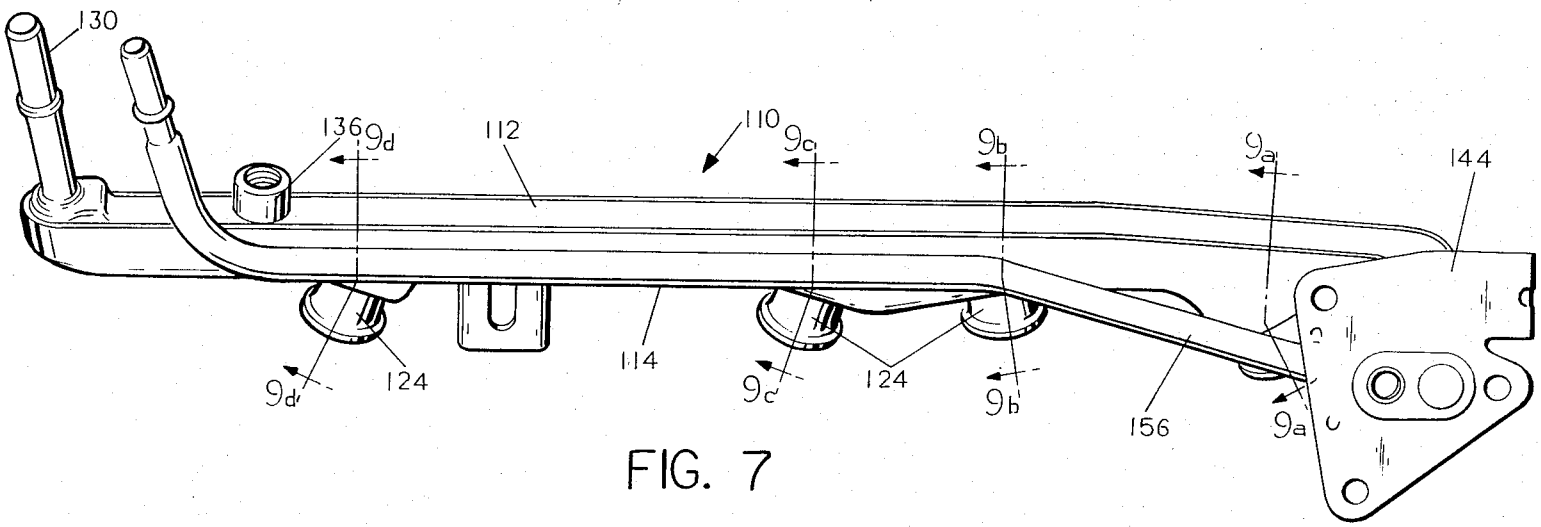
FIG. 7 is a side view similar to FIG. 4 but of a second fuel rail assembly embodiment.

Three embodiments of fuel rail assemblies made in accordance with the teachings of this disclosure are shown in the drawings. For a concise description and a better understanding of the principles involved, the corresponding parts of the three embodiments are given similar reference numerals. Now your attention is directed to FIGS. 1–6 wherein the fuel rail assembly 10 of the first embodiment is shown. It comprises two elongated stamped sheet metal rail members 12 and 14 which when assembled and brazed together form the rigid backbone or beam portion of the fuel rail. The assembled beam portion is hollow and has flat, preferably parallel, walls formed on opposite sides by the overlapping side walls 16, 17, 18 and 19 of the respective rail members 12 and 14 as can be seen best in the cross sectional portion of FIG. 5. The flat side walls 18 and 19 of the bottom rail member 14 are parallel and spaced apart so that they slide inside the parallel side walls of the top rail member 12 with a minimum of clearance. Basically the rail members 12 and 14 have generally U-shaped cross sections. The closed ends of the cross sections may be straight in both instances but preferably the closed end of the top rail member 12 is angular or convex to provide additional beam strength. The box-like structure with the double thickness brazed side walls provides a lightweight rigid beam that has increased strength in a preferred direction namely, in a direction parallel to the side walls. This feature serves to rigidly hold the fuel injectors during installation, operation and replacement. Various modifications could be made for the sake of convenience to the configuration of the rail members 12 and 14 without departing from this invention so long as the rail has essentially double thickness walls extending in the general direction of the axes 20 of the injectors (not shown). For example the side wall of the beam may have an inward depression as at 21 to provide clearance for an adjacent engine part.

The bottom rail member 14 has a plurality of apertured planar sites 22 protruding from its bottom wall. Their function is to contain and precisely align a corresponding number of injector sockets or cups 24. The planar sites 22 of this embodiment are disposed in spaced apart parallel planes and the cup apertures in the separate planar sites are centered on a straight line so that the rotational axes of all the cups fall in an imaginary plane extending perpendicular to the various planar sites. It should also be noted that the centers of the apertures are equidistant from the top of the beam and thus the injector cups are likewise equidistant from the top of the beam.

The injector cups 24 are deep drawn bell shaped sheet metal cups each having a flared lip 25 on its outer end followed by a shallow frusto-conical entrance 26 leading into a cylindrical body 27. This configuration provides for easy insertion of the "O" ring equipped top ends of the injectors and produces fluid tight seals between the cups and the top ends of the injectors when the injectors are fully seated in the cups. The top of the cup has an annular shoulder 28 with an extruded neck 29 that is capable of extending beyond the far side of the site aperture (see FIG. 2). Prior to the time the top rail member 12 is assembled on the bottom rail member 14, each cup is mechanically fixed in its rail aperture by peening, swaging, staking or otherwise expanding that portion of the cup neck which extends beyond the inside surface of the rail 14. The shoulder portion of the cup adjacent to the base of the cup neck abuts the planar site around the aperture and assures a precise self alignment of the cup axis 20 with the injector axis. One advantage of the close coupling of the injector cups to the rail is the prevention of vapor locks which occur in prior art fuel rail assemblies having elongated necks or connectors between the cups and the rail. Gasoline residing in such long prior art neck sections, particularly where the inside diameter (I.D.) of the neck is small, is likely to become vaporized upon being subjected to extremely high ambient temperatures, such as when an engine is idled for prolonged periods or shutoff temporarily during the hot weather. Another feature which serves to prevent vapor locks is the relatively large ID of the neck of the typical injector cup 24 of this invention. Its ID is at least one-half the diameter of the injector cup body 27. These features are especially important in view of the fact that state-of-the-art electromechanical fuel injectors may be damaged if operated even for short periods of time in the absence of liquid fuel. Installation of all the cups 24 in the rail member 14 may be done simultaneously. No separate jigs or fixtures are required for this final alignment. The preferred maximum tolerance for misalignment is one half degree. Thus it can be appreciated that improperly aligned injector cups or an easily bent beam member could result in out of tolerance misalignment of one or more of the fuel injectors.

Figure 1:
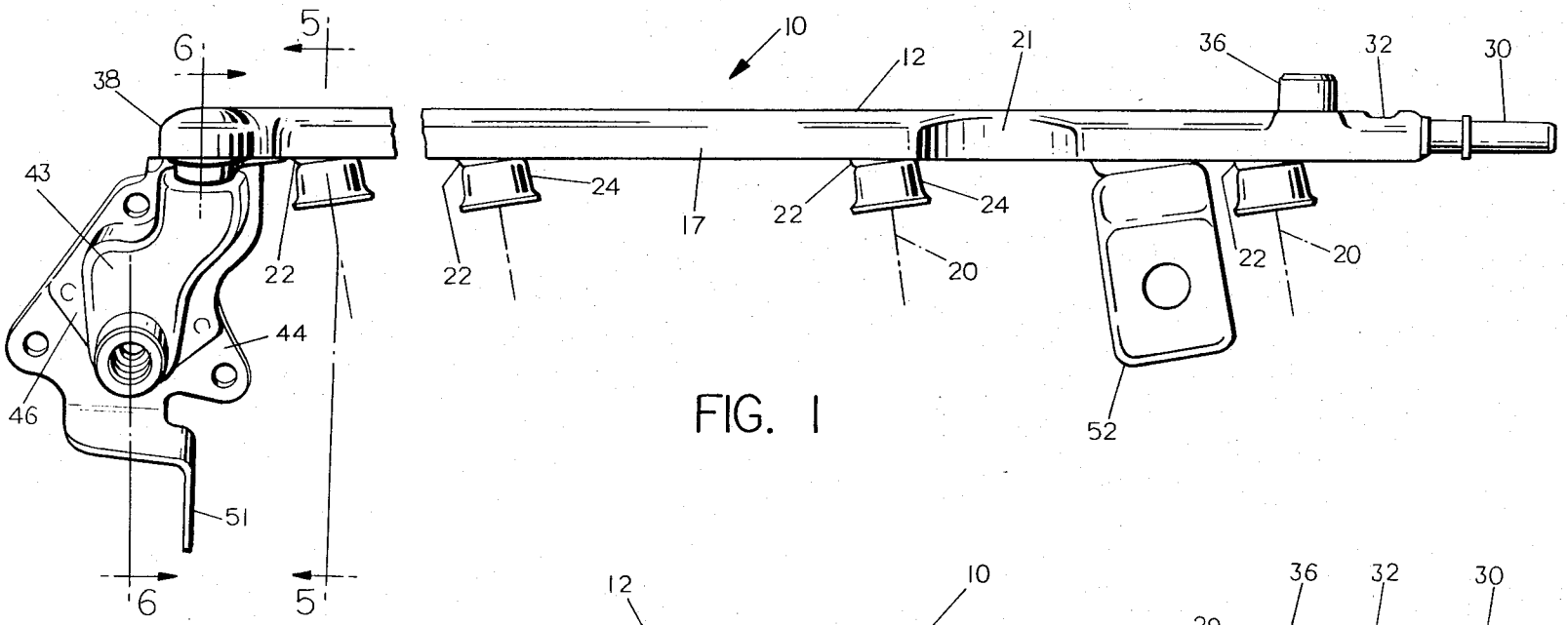
FIG. 1 is a side view of one fuel rail assembly embodiment made in accordance with the disclosure.
Figure 2:
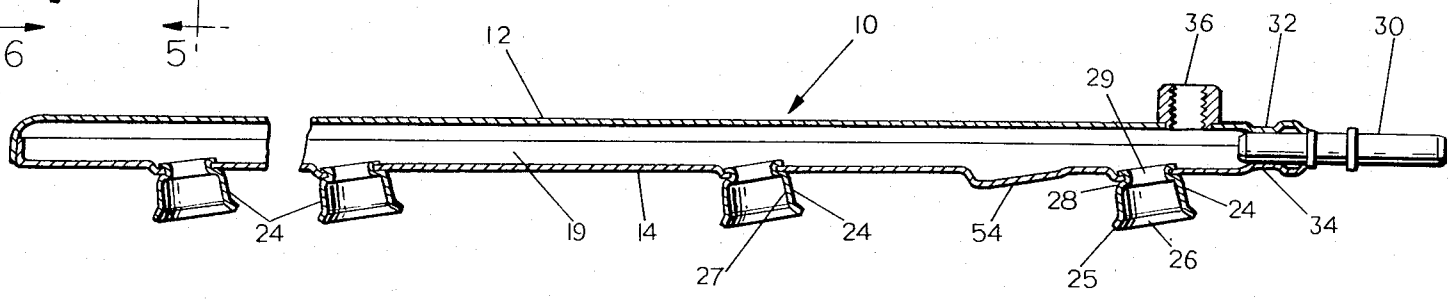
FIG. 2 is a sectional view of the beam portion of the assembly of FIG. 1 taken through the centers of the injector cups.
Figure 3:
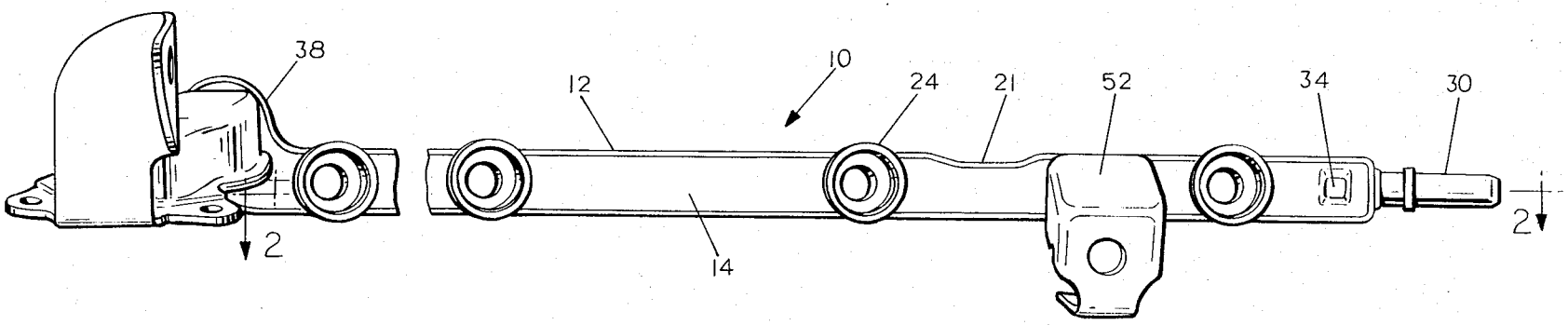
FIG. 3 is a bottom view of FIG. 1.
Figure 4:
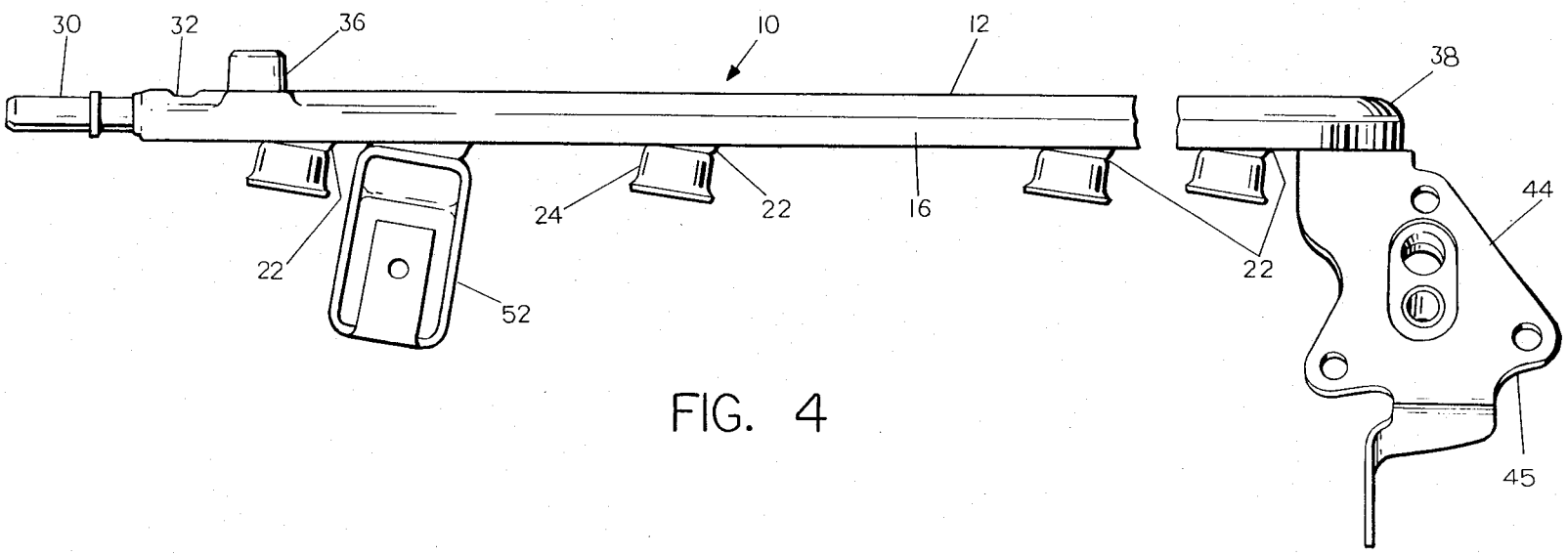
FIG. 4 is an opposite side view of FIG. 1.
Figure 9A:
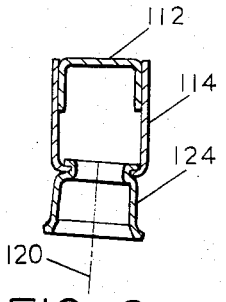
Figure 9B:
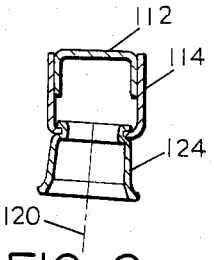
Figure 9C:
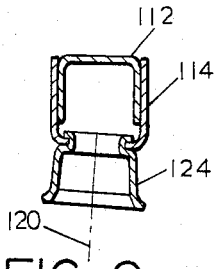
Figure 9D:
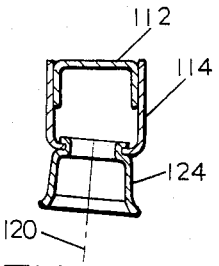

One end of the beam has an aperture containing a fuel inlet nipple 30 brazed therein. Preferably the nipple 30 extends a substantial distance, for example, about $\frac{5}{8}$" or more into the end of the beam and is sandwiched between opposed arcuate detents 32 and 34 in the top and bottom walls of the rail members 12 and 14 adjacent to the beam end as can be seen in FIG. 2. The detents and the nipple aperture in the end wall of the beam cooperate with the nipple during assembly to maintain the fuel inlet nipple in the axial alignment with the beam and also serve to fix the relative telescoped position of the two rail members 12 and 14. A threaded fitting 36 for a fluid line to a pressure monitor (not shown) may be incorporated in the top of rail member 12 adjacent to the end of the fuel inlet nipple 30 between it and the first injector cup.

The end of the beam opposite from the fuel inlet end has an integral arcuate elbow section 38 extending laterally from one side. An apertured nose section 40 with an extruded neck 41 on the underside of the outer end of the elbow is connected in communication with a pressure regulator well or sump chamber 42 formed by an irregularly shaped small well member 43 and a planar faceplate section 44 of a mounting fitment 45. To insure proper angular alignment between the rail 14 and well member 43, the base of the neck solution 41 extending from the nose on the elbow end of rail 14 is provided with an annular shoulder which abuts a planar surface surrounding the aperture of well member 43. The end of the neck protruding through the aperture is expanded and mechanically locked in the well member in the same fashion as the injector cups are locked in the rail 14. The adjoining top edge of the faceplate section is beveled to match the angle of its abutting portion of the rail 14 to further strengthen the connection between the members when they are brazed into a unit (see FIG. 6). The well member 43 has a planar peripheral flange 46 which is brazed to the back side of the faceplate section 44. Preferably the outline of the well member flange conforms to the shape of the top portion of the faceplate section 44 (see FIG. 1). An internally threaded return fuel line fitting 47 having a coaxially aligned short tubular extension 48 inserted in its inner end is brazed in an aperture in the body of the well member 43 such that the distal end of the tubular extension 48 protrudes through the sump chamber 42 into a coaxially aligned hole pierced in the faceplate section 44 (see FIG. 6). There is no direct communication between the sump and the inside of the fuel return fitting 47. Communication from the sump to the return line is only by way of a pressure regulator (not shown) mounted on the face of the faceplate section 44.

The face side or regulator side of the faceplate section 44 is provided with an oblong shallow recess for receiving a sealing gasket. The lower end of the recess is centered on the pierced aperture for the return line extension 48 and the upper end embraces a larger diameter extruded hole 49 which provides communication between the sump chamber 42 and the pressure regulator. Preferably the extruded neck of the pressure regulator hole 49 protrudes into the sump chamber a sufficient distance to provide a cylindrical sealing surface between it and an "O" ring equipped tubular connector of the pressure regulator inserted therein. The entrance end of the hole 49 may be chamfered or coined so as to provide a smooth frusto conical lead-in 50 for easing the tubular connector of the pressure regulator into the hole without damaging its "O" ring. Three mounting screw apertures disposed in a triangular configuration are provided in the faceplate section 44 for attaching the pressure regulator. An angular bracket 51 for anchoring the adjacent end of the fuel rail assembly 10 to the engine is integrally attached to the lower end of the faceplate section 44.

A second mounting bracket 52 for anchoring the other end of the assembly 10 to the engine is located in close proximity to the injector cup nearest that end and between it and the next cup. Preferably it is of a box-like construction drawn from a single blank of heavy gauge steel with four peripheral wall members connected to each other and to a common upright panel. One of the walls is connected by brazing to a planar site 54 protruding from the bottom of rail member 14. This planar site 54 is parallel with the planar cup sites 22.

The fuel rail embodiment 110 illustrated in FIGS. 7–9*d* has many of the same features as the previously described embodiment 10 but its configuration is different. Fuel rail assembly 110 is designed for an engine which has its injector axes askew with respect to one another and thus requires the injector cup axes 120 to be askew also. Another difference is that the distances between the top of rail member 112 and the centers of the various cup apertures in the planar sites 122 are not equal (see FIGS. 9*a–d*). As a result of these differences there is a lack of symmetry between the planar sites 122 and the rail member 114 containing them is deeper drawn than corresponding member 22. Although the side walls of rail members 112 and 114 extend in the general direction of the injector cup axes 120 they are not precisely parallel to them because the axes 120 are askew. In this embodiment the top of top rail member 112 is flat and its side walls are on the inside of the overlapping side walls of rail member 114. Another difference resulting from the lack of symmetry of the axes 120 is that the planar sites 122 are not parallel.

Figure 8:
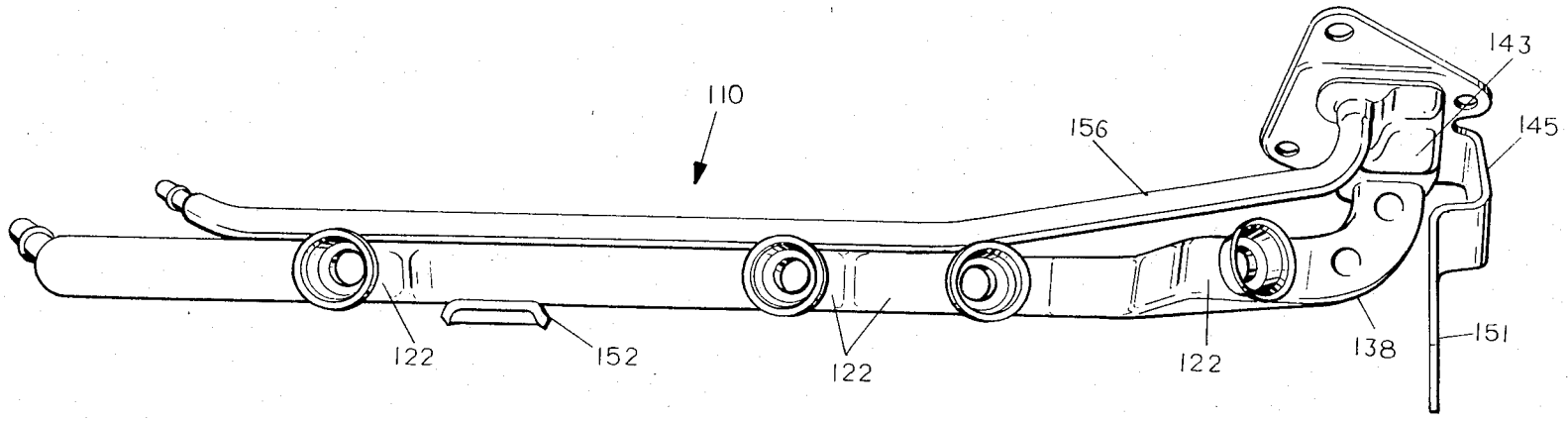
FIG. 8 is a bottom view of the FIG. 7 embodiment.

The elbow 138, well member 143 and mounting fitment 145 have somewhat different configurations than the corresponding elements 38, 43 and 45 of fuel rail assembly 10 but they perform essentially the same functions. One notable reason for the difference in the shape of these elements is that the fuel return line 156 is an integral part of the fuel rail assembly and thus there is no need for a threaded return line fitment, such as fitment 47. In this instance one end of a return fuel line tube 156 is bent as shown in FIG. 8 and fitted in corresponding holes in the well member 143 and faceplate section 144. The remaining portion of fuel return line 156 is curved upwardly towards the beam portion and extends along side it to the opposite end where it terminates in an upturned end. Preferably the line 156 is brazed to the side of the beam portion to support itself and in turn add beam strength to the fuel rail assembly 110. A fuel inlet nipple 130 is disposed in an upright position along side the upturned end of fuel return line 156 and is brazed in an apertured nose section formed in the top of rail member 112. A pressure modulator line fitment 136 is brazed in an aperture in the top rail 112 at approximately the same relative location as fitment 36 in embodiment 10.

Both fuel rail assembly embodiments 10 and 110 are made predominately of stamped sheet metal components that can be easily fitted together, properly aligned with one another and then brazed into a unit. Preferably the injector cups are made by deep drawing stamping processes which produce short extruded tubular necks on the top of the cups, substantially cylindrical cup body cavities and smoothly coined tapered lead-in surfaces on the inside of the entrance to the body cavities. The axial length of the neck section is less than the radius of the neck opening.

After the various components have been produced the first assembly step is to insert the cup necks into the planar site apertures of the bottom rail member and mechanically expand the portion of the neck of each cup that protrudes through its respective aperture to thereby lock each cup in the rail member. All the cups may be locked in the rail member simultaneously. Then the extruded neck on the nose of the elbow section of the rail can be locked likewise in its respective aperture in the well member. After that the faceplate section of the mounting bracket can be set in position on the well member such that its beveled edge is abutting the bottom of the rail member. The peripheral flange of the well member is spot welded to the faceplate section. At or near the same time the other mounting bracket may be preassembled on the bottom rail member also by spot welding. The next step is to insert the return line fitment or return line through the sump chamber into the pierced hole in the faceplate section. The installation of the fuel inlet nipple and the threaded fitting for the pressure monitor line may take place at any convenient time during the preassembly operations. The final preassembly step is to locate pieces of copper brazing material strategically amongst the parts and place the top rail member on or in the bottom rail member. When the preassembly of the components is completed, the unit is placed in a brazing furnace where all of the joints are fused and sealed together.

The embodiment illustrated in FIGS. 10–14 relates to a V-8 engine and has a pair of fuel rail assemblies which are similar to the previous described embodiments 10 and 110 except that the fuel ingress and egress apertures for each rail assembly 210R (FIG. 10) and 210L (FIG. 11) are at one end and the rail assemblies each has an internal divider 213 which provides internal fuel passageways in place of certain external fuel passageways. Although the dividers 213 are shown in right 210R and 210L fuel rail assemblies respectively for the right and left cylinder banks of a V-8 engine, many of the same teachings may be applied to fuel assemblies for V-6 engines or engines having a single row of cylinders.

Preferably the mating rail members of rail assembly 210R are of the same size and shape as the corresponding rail members of rail assembly 210L. They differ from each other in the type and location of various fitments attached to them and the location of the apertures associated with these fitments. Also the ends of the rail assembly 210R are oriented in reverse from those of rail assembly 210L. These rail assemblies 210R, 210L are comprised of top rail members 212, 312 and bottom rail members 214, 314 respectively. The top rail members 212, 312 have U-shaped cross sections formed by pairs of parallel side walls 216, 217, 316 and 317 connected by top walls 215, 315. The front end of rail member 312, being on the right side of FIG. 11, has a step 321 which reduces its height and corresponds to step 221 at the rear end of rail member 212 at the left side of FIG. 10.

The bottom rail members 214, 314 also have U-shaped cross sections formed by a pair of parallel side walls 218 and 219, 318 and 319 and connecting bottom walls 223, 323. A plurality of injector cups 224, 324 are mounted in apertured planar sites located at spaced locations along the bottom walls 223, 323. The side walls of the bottom rail members 214, 314 overlap the sidewalls of the top rail members 212, 312 and are bonded together to form fluid tight longitudinal side seams extending lengthwise of the elongated fuel rail assemblies 210R, 210L.

Preferably the dividers 213 for both the right and left rail assemblies 210R and 210L are also identical to each other in size and shape and each extends from a point between the pair of the injector cups 224, 324 at one end of a fuel assembly to a point between the pair at the other end. For the sake of brevity features of the divider 213 which are common to both rail assemblies will be described with respect to fuel rail assembly 210L, it being understood that they also apply to fuel rail assembly 210R. Each divider 213 has a pair of narrow spaced apart parallel side walls 368, 369 and a wider laterally disposed panel or wall 370 connecting the side walls together. The sidewalls 368, 369 are aligned with the sidewalls 318, 319 of the bottom rail member 314 and have a height sufficient to extend from the top edges of the bottom rail member 314 to the nearest lateral surface of the mating top rail member 312 as shown in FIGS. 13 and 14. The width of the divider 213 corresponds to the internal width of top rail member 312 so that the divider may be slipped into place during assembly and copper brazed to form the internal fuel passageways. One passageway defined by the walls of the divider and the top rail member 312 is closed at one end by a wall 380 and open at the other end. A fuel line crossover fitment 382 is attached to the top rail member 312 in fluid communication with this passageway at a location adjacent to the closed end thereof. The open end communicates with the other fuel passageway defined by the divider 213 and the bottom rail member 314. This latter passageway is in direct fluid communication with the injector cups 324. The lower passageway of fuel rail assembly 210R is also in direct fluid communication with the injector cups 224 and additionally is in direct fluid communication with a pressure regulator mounting fitment 245 through a fuel outlet aperture 246 (see FIG. 14). Mounting fitment 245 has the same elements as mounting fitment 45 described in detail with respect to the embodiment of FIGS. 1–6, but they have different configurations. Both the fuel inlet and fuel outlet are located at the same ends of their respective rail assemblies 210R and 210L as the crossover fitments 282 and 382. Thus the fuel enters the fuel rail assembly 210L through fuel inlet fitment 330 at the rear end thereof and flows forwardly in the lower passageway to the front end of the assembly whereat it reverses direction and flows rearwardly through the upper passageway exiting through the crossover fitment 382. From there is flows through a length of flexible tubing (not shown) to crossover fitment 282 of fuel rail assembly 210R where is enters the upper passageway thereof. The fuel then travels forwardly to the end of this passageway where it again reverses direction and flows rearwardly to the sump of the pressure regulator fitment 245. Excess fuel passes through a pressure regulator (not shown) then out through the return line fitment 247.

What I claim is:

1. A fuel rail assembly for holding a plurality of separate electromechanical fuel injectors in position on an internal combustion engine, said assembly comprising: an elongated hollow fuel rail beam, a plurality of injector cups mounted in a row along said beam in circular apertures, said cups being in direct fluid communication with the hollow interior of said beam, and a divider in said beam partitioning said interior into passageways one of which has a closed end and an open end, said open end being in fluid communication with another passageway which provides a fluid flow path in a counter current direction to the flow path of said first mentioned passageway.

2. A fuel rail assembly according to claim 1 wherein the length of said divider is less than the distance between the centers of the fuel injector cups at opposite ends of said row.

3. A fuel rail assembly according to claim 1 wherein the second mentioned passageway is in direct fluid communication with said injector cups.

4. A fuel rail assembly according to claim 1 wherein said fuel rail beam has a fuel line connector fitment located adjacent to the closed end of said first mentioned passageway and in direct fluid communication therewith.

5. A fuel rail assembly according to claim 1 wherein said fuel rail beam has a fuel line connector fitment located adjacent to the closed end of said first mentioned passageway and in direct fluid communication with said second mentioned passageway.

6. A fuel rail assembly according to claim 1 wherein said divider has a panel wall spanning the inside distance between opposing side surfaces of said beam and laterally disposed side walls attached to said surfaces.

7. A fuel rail assembly according to claim 1 wherein said fuel rail beam has a pressure regulator connector fitment connected to the end of said rail beam adjacent to the closed end of said first mentioned passageway.

8. A fuel rail assembly according to claim 7 wherein said fuel rail beam pressure regulator connector fitment includes a sump chamber in direct fluid communication with the second mentioned fluid passageway.

* * * * *